United States Patent [19]

Winkler

[11] 4,135,866

[45] Jan. 23, 1979

[54] LABORATORY GLASSWARE TAPER CONNECTOR SYSTEM WITH RETAINER AND BACKUP SEAL

[75] Inventor: Lyle D. Winkler, Wauconda, Ill.

[73] Assignee: Reliance Glass Works, Bensenville, Ill.

[21] Appl. No.: 828,761

[22] Filed: Aug. 29, 1977

[51] Int. Cl.[2] ..... B01L 3/00; B01L 11/00

[52] U.S. Cl. ..... 422/103; 215/276; 215/355; 285/DIG. 12; 285/332.1

[58] Field of Search ..... 215/355, 276, 1 R, 31; 285/DIG. 12, 332.1, 337; 210/DIG.23, DIG. 24; 23/292

[56] References Cited

U.S. PATENT DOCUMENTS

| | | | |
|---|---|---|---|
| 1,174,880 | 3/1916 | Lukens | 215/276 |
| 1,351,496 | 8/1920 | Spooner | 215/355 X |
| 1,977,241 | 10/1934 | Parker | 285/332.1 |
| 2,224,222 | 12/1940 | Geyer | 285/DIG. 12 |
| 2,457,384 | 12/1948 | Krenz | 285/DIG. 12 |
| 2,526,622 | 10/1950 | Martin | 215/355 |
| 3,066,819 | 12/1962 | Cox | 215/31 X |
| 3,334,025 | 8/1967 | Reid | 23/292 X |
| 3,446,381 | 5/1969 | Podesta et al. | 215/276 UX |
| 3,747,964 | 7/1973 | Nilsen, Jr. | 285/337 |
| 3,873,274 | 3/1975 | Neisius | 23/292 X |

OTHER PUBLICATIONS

Fisher Scientific Cat. 63, p. 105, #3-378.

*Primary Examiner*—Morris O. Wolk
*Assistant Examiner*—Michael S. Marcus
*Attorney, Agent, or Firm*—Darbo & Vandenburgh

[57] ABSTRACT

Standard chemical laboratory glassware taper joints are retained by a threaded cap which, when screwed onto a male threaded part surrounding the female standard taper element with an O-ring surrounding the glassware part at the shoulder of the standard male taper holds the tapered surfaces together under resilient pressure to maintain tight closure at the taper interface. The O-ring, being compressed between the threaded retainer cap as the applied force, and the shoulder of the male taper element and the top of the male threaded part, as force receiving surfaces, provides a backup seal for the joint.

3 Claims, 2 Drawing Figures

2
3
5
4
1
3
1
9
10
13
11
12
7
14
8
6
11

2
10
13
5
12
9
4
14
7
8
11
6
3
11

LABORATORY GLASSWARE TAPER CONNECTOR SYSTEM WITH RETAINER AND BACKUP SEAL

BACKGROUND AND SUMMARY OF THE INVENTION

Chemical glassware fittings, especially those provided for micro and sub-micro scale apparatus, is generally equipped with standard male or female tapered endings for cooperation with a mating standard taper surface to effect a joint which both mutually support the apparatus and provide a sealed connection of the parts. The tapered surfaces are ground to standard dimensions with close tolerances.

The part which terminates with a male taper is provided with a shoulder at the juncture of the large end of the taper and the body of the glassware part and the part which ends with a female taper is provided with an annular bead at the end of the part. A clip or clamp is used to hold the engaging taper surfaces together, gripping the shoulder and the bead for this purpose. Generally, a very thin coating of a suitable grease is applied to one of the engaging taper surfaces of a joint or a very thin Teflon gasket is provided to ensure a seal closure at the joint.

These clips and clamps are rather difficult to apply and are not entirely dependable since they may lose their grip on one of the parts, especially if accidentally jarred. There is always the possibility, also, that a joint, thought to be hermetically sealed, may leak, a condition that cannot be tolerated when working in micro and sub-micro scales.

The object of the present invention is to provide improved means for making dependably sealed taper joints in chemical glassware which embody taper connector systems. More specifically, the object is to provide a threaded retainer for taper joints which is capable of applying and maintaining sufficient mutual pressure at the engaging taper surfaces to ensure intimate, sealing contact. A further object is to provide a backup seal to maximize security against leakage at the joint. The backup seal is provided by an O-ring which is held under compressive pressure between a threaded cap and an annular shoulder of the glassware through which the taper joint is retained and the top of the associated part of the joint.

DESCRIPTION OF THE DRAWING

In the accompanying drawing.

DESCRIPTION OF SPECIFIC EMBODIMENT

Figure 1:
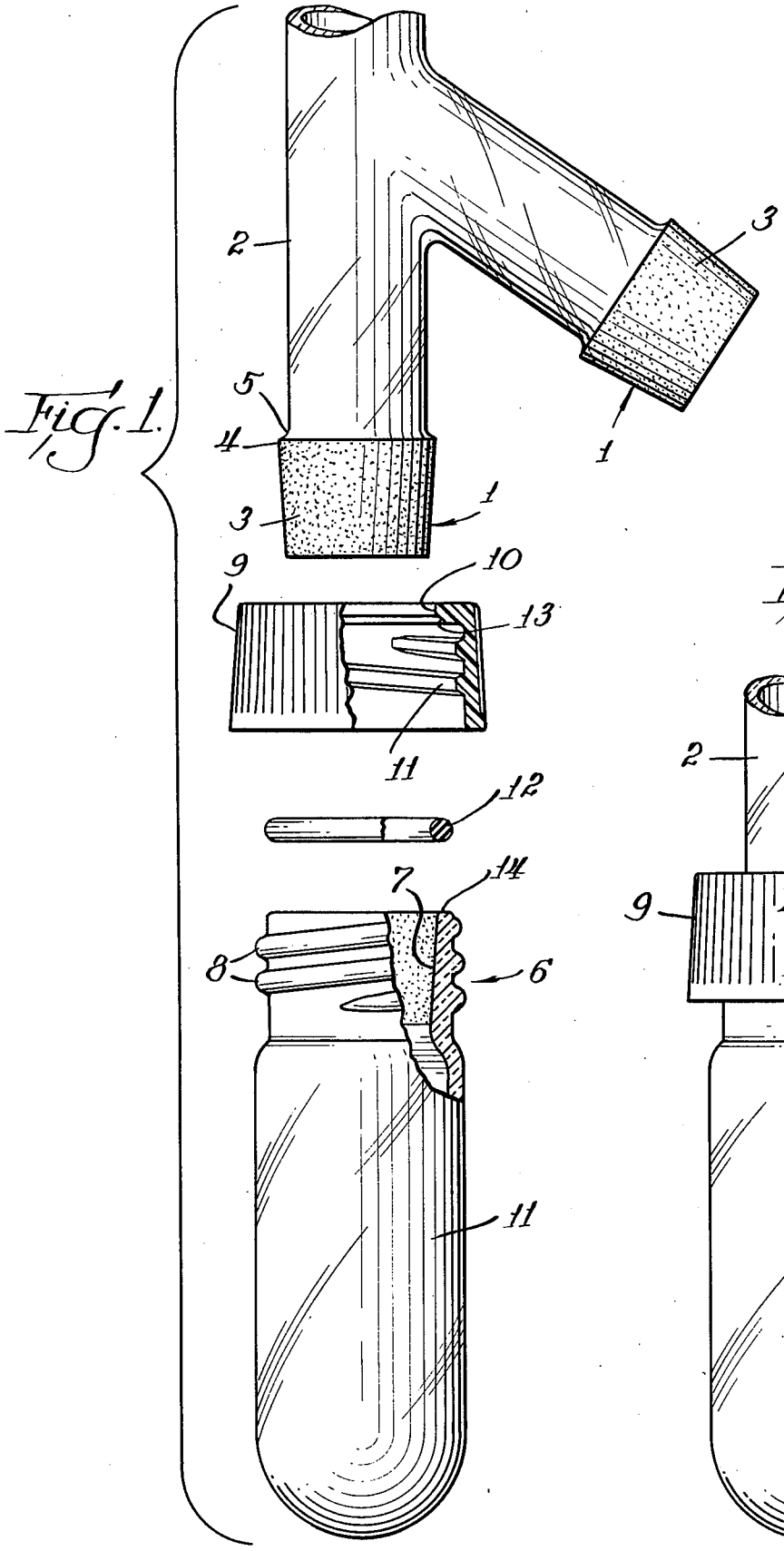
FIG. 1 is an exploded view showing the improved taper joint of the invention and FIG. 2 is an elevational view, partly in section, showing the assembled joint.

The invention contemplates the use of the male element of standard taper connector systems in chemical glassware, such as the tapered ends 1 of fitting 2 shown at the top of FIG. 1. The tapered surfaces 3 are made in accordance with standard specifications which determine the degree of taper, the length of the taper portion and the outside diameters at both ends of the taper portion. A shoulder 4 is formed at the juncture 5 of the taper portion with the body of the fitting. In accordance with established practices, these shoulders are engaged by clamps or clips to retain the standard taper joints.

In accordance with the invention, the female taper joint element 6 is made with a standard taper surface 7 with which the male taper surface 3 mates in the joint but is provided with external threads 8, as shown. A cap 9 having a central hole 10 is internally threaded at 11 to be screwed upon the correspondingly threaded top of vial 11.

The inside diameter of hole 10 is approximately the same as the outside diameter of shoulder 4, being great enough to clear the shoulder as the cap is moved over the tapered end 1 and onto the body of the fitting. The hole leaves an annular flange extending inwardly from the top of the rim of the cap.

Figure 2:
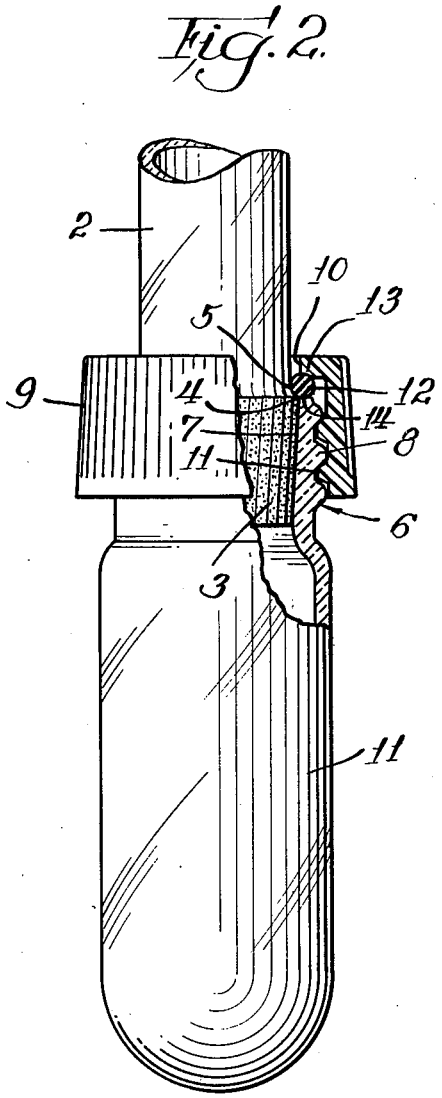

An O-ring 12 is provided to seat upon shoulder 4 in the juncture 5 of the fitting with the cap located on the associated leg of the fitting. The normal inside diameter of the O-ring is slightly less than the diameter of the leg of fitting 2 so that when stretched and passed over shoulder 4, it will seat snugly upon the fitting at juncture 5. The outside diameter of the O-ring is greater than the inside diameter of the hole 10 in the top of cap 9, as shown in the assembly of FIG. 2, by an amount sufficient to ensure a secure grip by the annular flange upon the O-ring as the cap is screwed upon the top of vial 11.

As already indicated, the taper joint in accordance with the invention is made by slipping a cap 9 over the male taper element after which the O-ring is slid or rolled along the taper surface just past the shoulder so that it seats in position at the juncture of the tapered end 1 with the associated leg of fitting 2. The male taper is then fitted into the female taper 7 of vial 11 and the cap is screwed down firmly onto the top of the vial. As the cap is tightened, compressive pressure is brought to bear against the O-ring which is then compressed between three annular surfaces, the internal peripheral marginal portion 13 of the cap, the shoulder 4 at the large end of the male taper, and the top edge 14 of the vial. Thus, the O-ring, when subjected to such compression, bears against the shoulder 4 to urge the male taper 3 into pressure engagement with the female taper 7, at the same time pressing tightly against the top edge 14 of the vial. Accordingly, in addition to retaining the taper joint in tightly closed position, the interface is sealed at its top by the O-ring to provide what might be considered to be a backup seal to maximize the dependability of overall joint seal.

It will be understood that the special female taper fitting with external threads, as described, to receive a retainer cap may be provided not only at the mouths of a variety of vials and flasks and the like, but may be provided at the female tapers on complete lines of fittings having male taper ends in the manner of the assortment of fittings for taper connector systems presently available with standard male and female taper ends.

The retainer system of this invention provides satisfying assurance that a joint will remain intact with a dependable seal. The resilient pressure applied through the O-ring tends to improve the connection so that for many purposes the greasing of a taper surface or provision of a Teflon gasket is unnecessary. Furthermore, the provision of the backup seal in accordance with the invention greatly increases the overall security of the seal, further extending the conditions under which the grease or gasket expedients may be omitted.

I claim:

1. In a laboratory glassware taper connector system including first and second parts to be connected having respectively tapered male and female end portions in mating engagement to form a joint, said first part having an annular shoulder at the large end of the taper thereon, the improvement comprising a male screw thread formed on the end portion of said second part, an O-ring encircling said first part in engagement with said shoulder, and a cap having a female screw thread in the rim thereof adapted to mate with said male screw thread, said cap having a central hole in the top thereof leaving an annular flange extending inwardly from the top of said rim and engaging said O-ring, the diameter of said hole being approximately equal to but not less than the outside diameter of said shoulder, the arrangement being such that when said cap is screwed tightly upon said male thread the O-ring is compressed and presses against said shoulder to urge and maintain said male taper into tight engagement with said female taper of said connector system.

2. Structure in accordance with claim 1 wherein the male screw thread surrounds the taper at the end of the second part.

3. Structure in accordance with claim 1 wherein the end of said second part is located approximately in the plane of the shoulder on the first part in the assembled joint whereby the O-ring presses against said end of said second part as well as against said shoulder when the cap is tightened, to form a backup seal for the joint.

* * * * *